United States Patent [19]

Chestnut et al.

[11] Patent Number: 4,756,165

[45] Date of Patent: Jul. 12, 1988

[54] SINGLE REVOLUTION ICE MAKER

[75] Inventors: Paul B. Chestnut, Armstrong Township, Vanderburgh County; Ronald W. Guess, Evansville, both of Ind.

[73] Assignee: Whirlpool Corporation, Benton Harbor, Mich.

[21] Appl. No.: 81,871

[22] Filed: Aug. 3, 1987

[51] Int. Cl.[4] ..... F25C 5/08

[52] U.S. Cl. ..... 62/135; 62/351

[58] Field of Search ..... 62/135, 73, 351

[56] References Cited

U.S. PATENT DOCUMENTS

| | | | |
|---|---|---|---|
| 2,717,500 | 9/1955 | Ploeger | 62/7 |
| 2,717,501 | 9/1955 | Anderson | 62/7 |
| 2,717,504 | 9/1955 | Knerr | 62/7 |
| 2,869,060 | 1/1959 | Chace | 62/351 X |
| 2,941,378 | 6/1960 | Nelson | 62/351 X |
| 2,955,442 | 10/1960 | Loewenthal | 62/351 |
| 3,034,312 | 5/1962 | Harle | 62/351 X |
| 3,144,078 | 8/1964 | Morton et al. | 62/351 X |
| 3,208,233 | 9/1965 | Linstromberg | 62/137 |
| 3,276,225 | 10/1966 | Linstromberg | 62/353 |
| 3,359,747 | 12/1967 | Linstromberg | 62/135 |

*Primary Examiner*—William E. Tapolcai

*Attorney, Agent, or Firm*—Wood, Dalton, Phillips, Mason & Rowe

[57] ABSTRACT

An ice making apparatus utilizes a single thermostat for energizing and de-energizing a mold heater which is utilized to free ice bodies from a mold. The thermostat has a narrow operating range so that the heater is de-energized substantially immediately after the ice body is free from the mold to enable harvesting of the ice bodies to be completed in a single revolution of an ejector blade. The short time during which the heater is on allows a subsequent freezing cycle to be completed faster and the single revolution permits the harvesting cycle to be completed faster in order to increase ice production of the ice maker.

22 Claims, 3 Drawing Sheets

FIG. 1
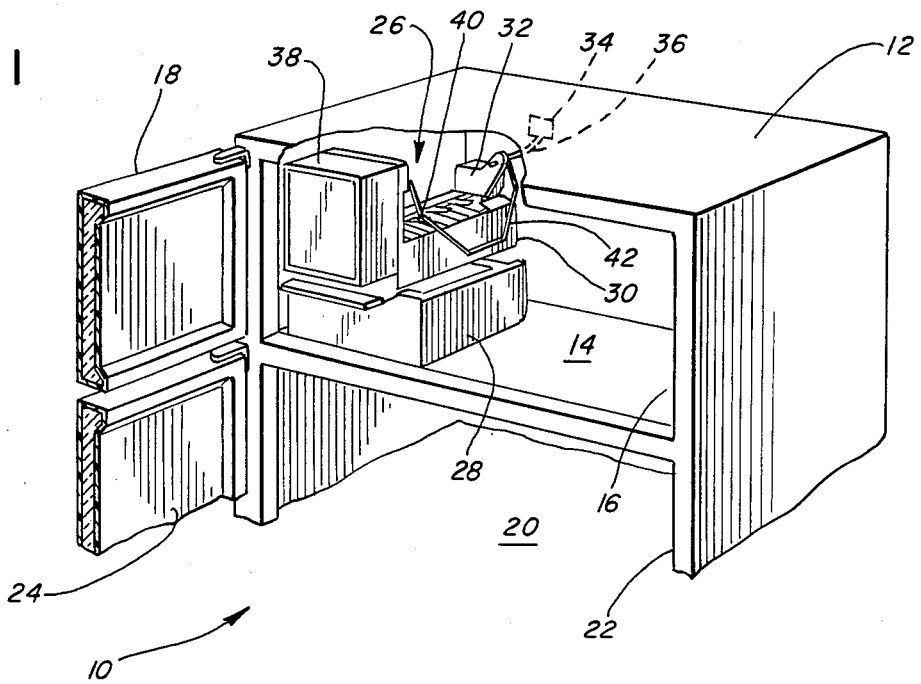
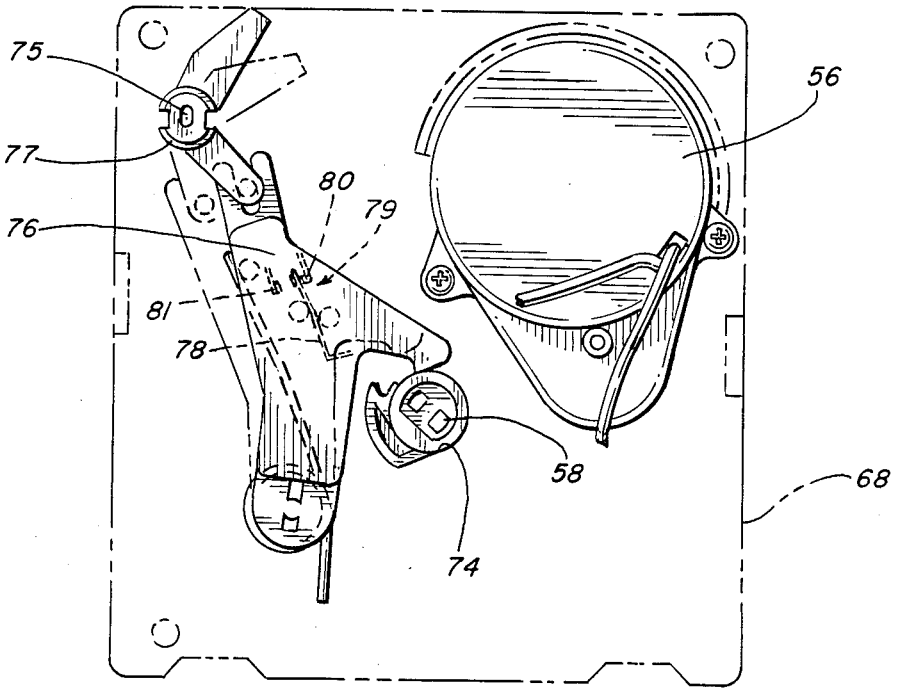
FIG. 6

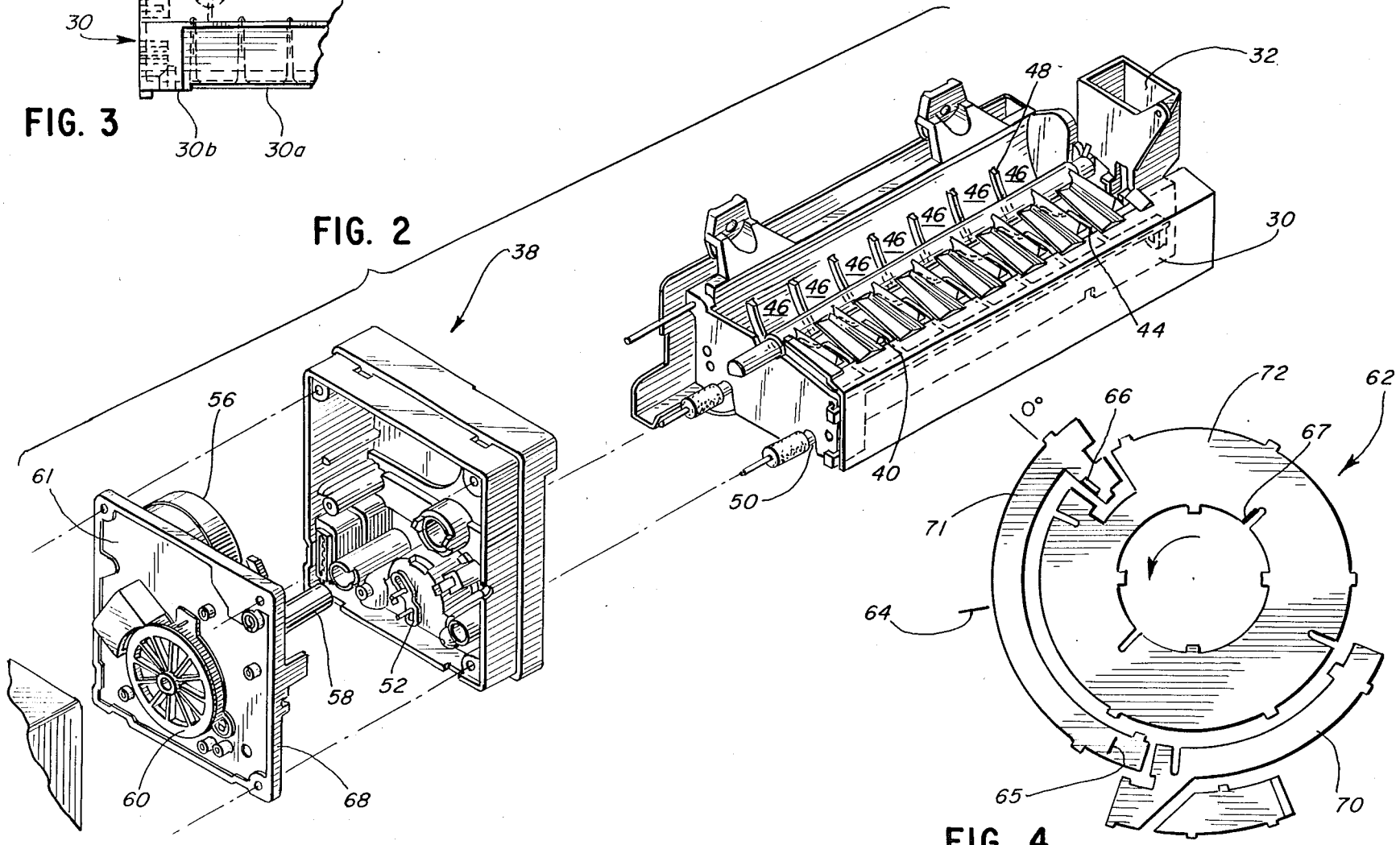
FIG. 2
FIG. 4
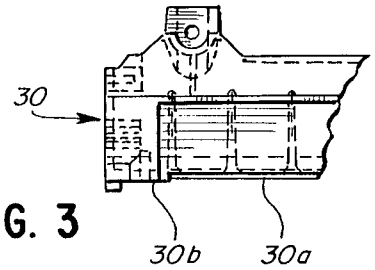
FIG. 3

FIG. 5
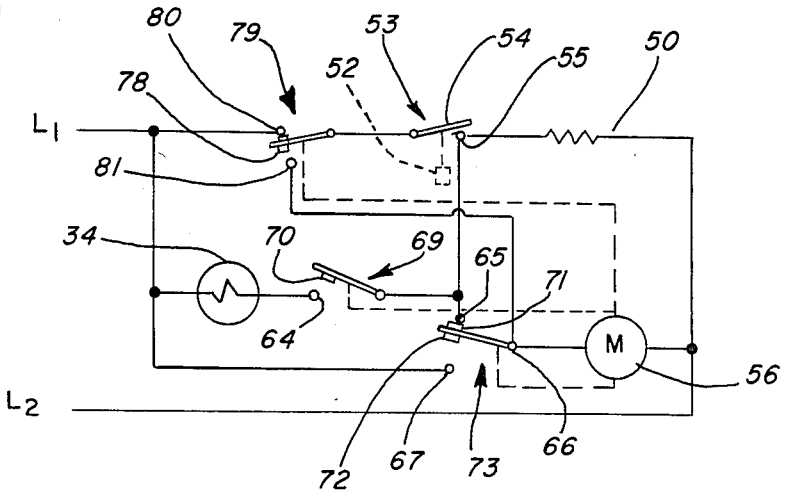
FIG. 7
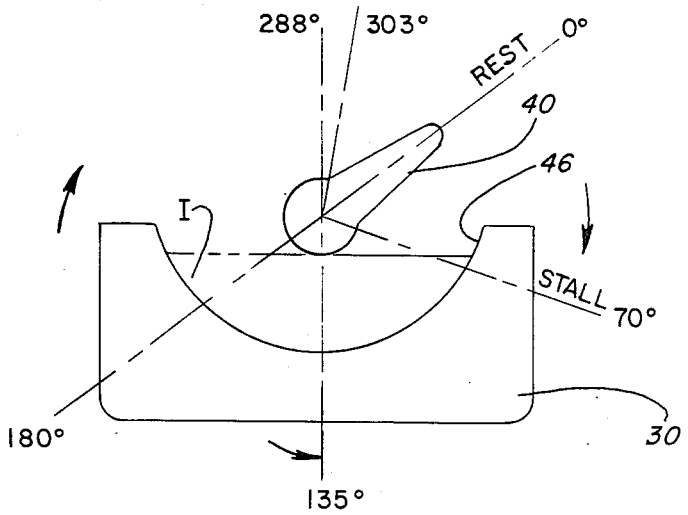
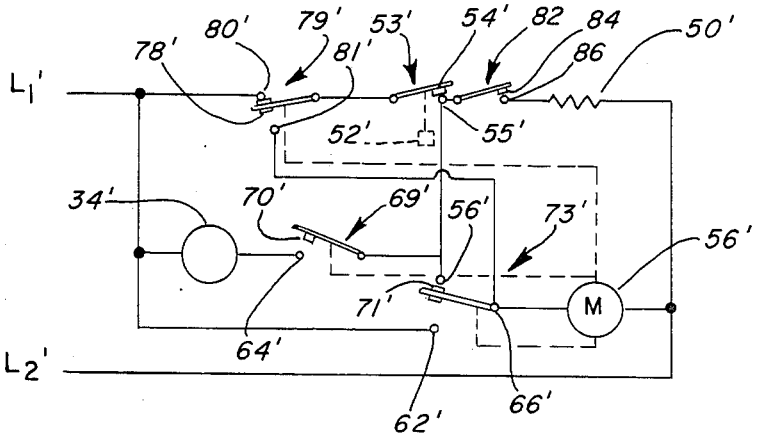
FIG. 8

SINGLE REVOLUTION ICE MAKER

BACKGROUND OF THE INVENTION

1. Field of the Invention

This invention relates generally to ice makers, and more particularly, to an improved ice maker for use in domestic refrigerators and the like.

2. Description of Background Art

In one form of an ice maker, an ice mold and associated mechanism are mounted in the freezer compartment of a domestic refrigerator/freezer apparatus. One example of such an ice maker is illustrated in Linstromberg, U.S. Pat. No. 3,276,225, which is owned by the assignee of the present invention. Such ice makers are provided with resistance heaters for heating the mold upon completion of the forming of the ice bodies therein so as to permit freeing of the ice bodies therefrom for dispensing automatically to a subjacent collecting bin. A thermostat in heat transfer association with the mold senses when the ice bodies are sufficiently frozen and thereafter initiates an ejection cycle. During the ejection cycle, ejector blades move through the cavities in which the ice bodies are formed to force the ice bodies therefrom for delivery to the bin. The cycle is completed after the mold warms up to a temperature sufficient to allow for resetting of the thermostat. As described in the Linstromberg patent, the ejector must rotate two complete revolutions in the cycle in order to allow for sufficient time for the mold to warm up to reset the thermostat. The resistance heater remains energized for the entire time.

As a result of the ejector going through two complete revolutions, the total cycle time of harvesting ice is increased. Since the heater remains on for most of the cycle time, a greater time is required for a subsequent batch of ice to be made as the heater causes the mold to be at an elevated temperature on the order of 80° to 100° F. Also, the electrical and mechanical components are subject to additional stress due to the need for two complete revolutions.

Another type of ice maker is described in Andersson, U.S. Pat. No. 2,717,501 wherein an ejector must pass through only a single revolution in the ice harvesting cycle. Here again, however, a heater is energized via a first thermostat immediately at the start of the harvesting cycle and remains energized throughout the entire cycle. A second thermostat acts as a high temperature switch to shut off the heater if the control malfunctions. It is believed that the heater is energized for the full cycle in order to reset the thermostat. The heater being energized for the full cycle causes the mold to be at an elevated temperature, increasing ice making time and decreasing reliability of components therein, as described above.

The present invention overcomes the above problems of prior art ice makers in a novel and simple manner.

SUMMARY OF THE INVENTION

In accordance with the present invention, an ice maker is provided which is operable to de-energize a mold heater element while at least a portion of the ice bodies are still within the mold.

Broadly, there is disclosed herein an ice making apparatus including a mold in which water is frozen to form an ice body. Also included are an electric motor and means for ejecting the ice body from the mold. An electric heater is in heat transfer association with the mold operable to free the ice bodies from the mold prior to the operation of the ejecting means to eject the ice bodies. A control circuit includes a thermostat responsive to the temperature of water in the mold. A thermostat switch is controlled by the thermostat to initiate operation of the motor for ejecting the ice body upon complete freezing thereof and concurrently energizing the heater. An electric circuit means includes the thermostat switch, the motor, and a second switch controlled by the operation of the motor for maintaining energization of the motor independently of the first switch and causing the thermostat switch to control further energization of the heater whereby the thermostat switch de-energizes the heater within a single revolution of the ejecting means.

The present invention comprehends the use of a thermostat comprising a bi-metal which opens at a low reset temperature on the order of 32° F. Accordingly, the thermostat de-energizes the heater shortly after the time at which the ice bodies are freed from the mold.

In another form of the invention, a cam operated switch is actuated in association with the rotation of the ejecting means for de-energizing the heater substantially immediately after the ice body is freed from the mold.

It is another object of the present invention to provide an ice maker that minimize overheating of the mold during a harvesting cycle to increase ice production.

It is yet another object of the present invention to provide an ice maker operable to complete a harvesting cycle in a single revolution of the ejecting means to increase ice production and reliability and life of components in the ice maker.

It is a further object of the present invention to provide an ice maker operable to reduce the time during which the mold heater is energized.

It is still a further object of the present invention to provide an ice maker having a mold exhibiting improved heat transfer.

Further features and advantages of the invention will readily be apparent from the specification and from the drawings.

BRIEF DESCRIPTION OF THE DRAWINGS

FIG. 1 is a fragmentary perspective view of a refrigeration apparatus having an ice maker embodying the invention;

FIG. 2 is an exploded perspective view of a portion of the control of the ice maker;

FIG. 3 is a fragmentary elevational view of a mold forming part of the ice maker;

FIG. 4 is a circuit diagram of a face cam forming part of the control of the ice maker;

FIG. 5 is a schematic electrical wiring diagram illustrating the circuitry of the ice maker;

FIG. 6 is an enlarged partial perspective view of a portion of the control of the ice maker;

FIG. 7 is a timing chart illustrating various rotational positions of the ejector relative to switching actuated by the face cam of FIG. 4; and FIG. 8 is a schematic electrical wiring diagram illustrating the circuitry of an alternate embodiment of an ice maker.

DESCRIPTION OF THE PREFERRED EMBODIMENT

In one embodiment of the invention as disclosed in FIGS. 1–6, a refrigeration apparatus 10 includes an insulated cabinet 12 defining a freezing chamber 14 having a front opening 16 selectively closed by a door 18. The cabinet 12 further includes a fresh food chamber 20 having a front opening 22 selectively closed by a second door 24. An ice maker 26 is disposed within the freezing chamber 14 for forming ice bodies and delivering them to a subjacent collecting bin 28 also disposed within the freezing compartment 14. The compartments 14 and 20 are refrigerated by a suitable evaporator (not shown) disposed within the walls of the cabinet 12. the evaporator forms a portion of a conventional refrigeration circuit including connected components such as a compressor, condenser, capillary and conduit (not shown) for delivering the refrigerant to and from the evaporator.

The ice maker 26 includes a mold 30 in which ice bodies are formed, water being delivered to the mold 30 by an inlet 32 connected to a solenoid operated valve 34 by delivery tube 36. Solenoid valve 34 may be connected to a suitable source of water under pressure (not shown). The ice maker 26 further includes a control 38 disposed at the front end of the mold 30 and arranged to operate an ejector blade 40 which upon completion of the freezing of the ice bodies in the mold 30 removes the ice bodies from the mold 30 to the subjacent collecting bin 28. A pivotally mounted sensing arm extends downwardly above the collecting bin 28 to sense the level of ice bodies in the bin 28.

MOLD

With reference to FIG. 2, the mold 30 is shown to comprise a tray structure having a plurality of partition walls 44 extending transversely across the mold to define a plurality of cavities 46 in which a corresponding plurality of ice bodies are formed. The partition walls 44 are provided with recess portions 48 defining weirs between the respective cavities 46 to permit water to flow from cavity to cavity during the filling operation.

The removal of ice bodies from the mold cavities 46 is facilitated by means of a resistance heater element 50 extending through the mold 30 on the underside thereof. The heater 50 warms the mold sufficiently to melt the surface of the ice bodies engaging the walls of the mold cavities and thereby free the ice bodies for ejection from the cavities by the ejector blade 40.

The mold 30 is manufactured of a light weight aluminum to permit faster heat transfer. Accordingly, ice bodies may be harvested at a greater frequency. Referring particularly to FIG. 3, a greater mass of such aluminum is provided on the underside 30*a* of the mold at one end 30*b* thereof. The added mass at the one end 30*b* ensures that this is the last portion of the mold to cool during the freezing process.

CONTROL

With particular reference to FIGS. 2–5, the control 38 includes a thermostat 52 in heat transfer association with the mold 30 at the one end 30*b* thereof. The thermostat 52 comprises a bi-metal device including a switch 53 having a movable contact 54 and a fixed contact 55. The bi-metal of the thermostat 52 is operable to move the movable contact 54 in electrical contact with the fixed contact 55 when the sensed temperature of the mold is below 15° F., and to reset at a low temperature, by breaking contact between the movable contact 54 and fixed contact 55, on the order of 32° F.

The control 38 further includes a motor 56 which rotates a shaft 58 carrying the ejector blade 40 and a cam 60 on a front side 61 of a base plate 68. A rear surface of the cam 60 includes a face cam circuit 62 illustrated in FIG. 4. The face cam circuit 62 comprises bands of electrically conductive material adhered to the rear face of the cam 60. The face cam circuit 62 is illustrated in the at-rest rotational position with the zero degree home position indicated in the upper left-hand corner. Fixed contacts 64–67 comprise electrically conductive face brushes, retained by the base plate 68, in fixed axial and radial positions relative to the cam circuit 62. A first circuit path 70 of the face cam circuit 62 comprises a movable contact in radial alignment with fixed contacts 64 and 65 defining a water valve switch 69. Similarly, a second circuit path 71 comprises a movable contact in radial alignment with fixed contacts 65 and 66 defining a holding switch 73, and a third circuit path 72 comprises a movable contact in radial alignment with fixed contacts 66 and 67 also part of the holding switch 73.

With particular reference to FIG. 6, a rear cam 74 rotationally secured to the shaft 58 and axially associated with the cam 60 cooperates with a pivotally mounted shut-off plate 76 for controlling the sensing arm 42. The sensing arm 42 pivots in an aperture 75 of a plate 77 engaged by the shut-off plate 76. The shut-off plate 76 further engages a movable contact 78 of a shut-off switch 79 having fixed contacts 80 and 81. The switch 79 is biased to engage its moving contact 78 with the fixed contact 80 when the control 38 is arranged, as shown in solid lines in FIG. 6.

OPERATION

The operation of the control 38 is as follows. Assuming that the molds contains a quantity of water in the process of being frozen to form the ice bodies in the cavities 46 and the level of the ice bodies in collecting bin 28 is below the preselected full level, the mold thermostat 52 senses a relatively warm condition whereby the switch 53 is in the open condition, as shown in FIG. 5. Further, shut-off switch 79 has movable contact 78 in contact with fixed contact 80, the holding switch 73 has the moving contact 71 thereof in contact with the fixed contact 65 and the water valve switch 69 has its movable contact 70 spaced from its fixed contact 64. Thus, the control 38 is in a de-energized condition between power supply leads L1 and L2.

As described above, the thermostat 52 is arranged to have a cut-in temperature of 15° F. and a reset or cut-out temperature of 32° F. Thus, when the water in the mold cavity 46 becomes completely frozen and the temperature thereof drops to 15° F., the thermostat switch 53 is operated to close contact 54 with contact 55, thereby establishing a circuit from power supply lead L1 through contacts 80 and 78 of switch 79, contacts 54 and 55 of switch 53, and through the heater 50 to lead L2. At the same time, the control motor 56 is energized from contact 55 through contacts 65 and 71 of the holding switch 73. This causes the cam 60 to rotate from the zero degree rest position illustrated in FIG. 7. The cam face circuit 62 of FIG. 4, is accordingly rotated in a counter-clockwise direction, whereupon, after a few degrees of rotation, the second cam surface path 71 breaks contacts between fixed contact 65 and 66, and the third cam surface path 72 makes contact between fixed contacts 66 and 67 thereby establishing a holding circuit from lead L1, through contacts 67 and 66 to motor 56 whereby the motor 56 is energized regardless of the condition of the thermostat switch 53.

After an additional amount of rotation of the shaft 58 the rear cam 74 causes the shut-off plate 76 to pivot in a counter-clockwise direction, see FIG. 6, thereby swinging the plate 77 and thus the sensing arm 42 upwardly from the collecting bin 28. At the same time, the shut-off plate 76 breaks contact between moving contact 78 and the fixed contact 80 and makes an electrical contact between the movable contact 78 and the fixed contact 81 as shown in dashed lines. This establishes a circuit to the heater 50 from lead L1 through contacts 67 and 66 of holding switch 73, contacts 81 and 78 of shut-off switch 79 and contacts 54 and 55 of thermostat switch 53. Thus, the control motor 56 is energized independently of the thermostat switch 53, while the heater 50 is energized under the control of the thermostat switch 53 at this time.

The operation of the motor 56 causes rotation of the shaft 58 until the ejector blade 40 engages the ice bodies I within the mold cavity 46 at approximately 70° of rotation. In the event the ice bodies have not been freed from the mold walls, the motor 56 stalls until such time as the mold heater 50 melts the ices bodies free. The motor then continues rotation of the ejector blade 40, to move the ice bodies from the cavities 46. At the same time, shut-off plate 76 is pivoted by the cam 74 to lower the sensing arm 42 into the collecting bin 28. If the level of the ice bodies collected in bin 19 is below the preselected level, the arm 42 moves downwardly into the bin 28 and allows the plate 76 to pivot sufficiently to permit the movable contact 78 to become repositioned, as shown in FIG. 6, with the movable contact 78 spaced from the fixed contact 81 and now engaging the fixed contact 80.

Between approximately 135° and 180° rotation of the ejector blade 40 the heater 50 will have heated the mold up sufficiently, i.e. 32° F., to reset the thermostat 52 and accordingly open the switch 53 by moving the movable contact 54 thereof away from the fixed contact 55, thus de-energizing the heater 50. This results in the heater 50 being de-energized while the ice bodies are still partially within the mold 30. The mold 30 continues to heat up slightly due to heat dissipation from the heater 30, preventing the ice bodies from again freezing to the mold 30. However, the temperature of the mold should not exceed 40° F. As the holding switch 73 is arranged with fixed contact 66 and 67 electrically connected, the control motor 56 continues to operate.

At approximately 288° of rotation, the first face cam path 70 completes an electrical contact between fixed contacts 64 and 65 of water valve switch 69. Since switch 53 is now open, the solenoid 34 becomes energized to admit water through the inlet 32 to the mold cavity 46 for forming a subsequent group of ice bodies in mold 30. After a preselected period, for example, at 303° rotation, the water valve switch 69 opens by the first face cam surface path 70 breaking contact between fixed contacts 64 and 65, thereby terminating the flow of water to the mold cavitites 46. The completion of the control cycle occurs upon a small additional operation of the motor 56 whereby the third cam surface path 72 breaks contact between the fixed contacts 66 and 67 to open the holding switch 73. The control 38 is now fully de-energized at the beginning of the operation cycle as discussed above, whereby a subsequent cycle will become initiated by the completed freezing of the ice bodies in the mold as discussed above.

When a sufficient number of ice bodies have been delivered to the collecting bin 28 so as to cause the level therein to rise to a preselected full level, the operation of the control 38 as discussed above will be interrupted by preventing the shut-off plate 76 from returning to the position of FIG. 6. Thus, the movable contact 78 remains in engagement with the fixed contact 81 and the circuit remains broken between the contacts 78 and 80. This condition will remain until such time as the level of ice bodies in the bin is lowered as by removing some or all of the ice bodies therein. When this occurs, the release of the sensing arm 42 permits the return of shut-off plate 76 to the position of FIG. 6, thereby allowing the switch to close movable contact 78 with fixed contact 80 and permitting subsequent operation of the control 38, as discussed above. It should be noted that this termination of operation of control 30 may occur during the rotation of the cam 60 and the operation of control 38.

Thusly, the control 38 utilizes a single thermostat 52 to control both the mold heater 50 and the control motor 56. The control is arranged to prevent overheating by the mold heater 50 such as might occur if the control motors 56 or the holding switch 73 fails or the ejector blade 41 becomes jammed, such as by interference with the mold walls. Moreover, by utilizing a thermostat having a narrow operating range, the temperature of the mold will be generally maintained near the upper and lower limits of the thermostat, herein 32° F. and 15° F., respectively, and the ice maker is operable to complete a cycle during a single revolution of the ejector 40.

The provision of a single revolution ice maker, with the control de-energizing the heater shortly after the ice bodies are freed from the mold, enables the ice maker embodying the invention to harvest a minimum of one additional batch per day. Also, less energy is required to produce the ice, resulting in decreased energy costs.

MODIFIED CONTROL

Referring to FIG. 8, a modified electrical schematic diagram similar to that in FIG. 4 is illustrated. The schematic utilizes primed reference numerals to indicate items similar to those previously discussed above. The modified control further includes a cam operated heater shut-off switch 82 between the heater 50′ and the fixed contact 55′ of the thermostat switch 53′. The shut-off switch 82 includes a movable contact 84 and a fixed contact 86.

The heater shut-off switch 82 is similar in construction and operation to the shut-off switch 79 shown in FIG. 6. However, the heater shut-off switch 82 is normally in a closed position with its movable contact 84 in contact with the fixed contact 86. The heater shut-off switch 82 is operable to open the circuit to the heater 50′ by moving the movable contact 84 away from the fixed contact 86 when the ejector 40 has rotated far enough to guarantee the ice is freed from the mold 30, such as between 90° and 135° rotation. In this alternative embodiment, a thermostat switch 53′ is also utilized so that the heater 50′ could be turned off sooner if the mold temperature exceeded 32° F. before the heater shut-off switch 82 is actuated. However, the thermostat shut-off switch 82 ensures that the heater 50′ is de-energized substantially immediately after the ice bodies are free from the mold.

In all other respect, the operation of the ice maker according to the alternative embodiment of the invention is identical to that discussed above, and therefore will not be discussed in detail herein.

Thus, the invention broadly comprehends an ice maker which provides a shut-off for a mold heater substantially immediately after the ice bodies are freed from a mold to increase production of ice by the ice maker.

The foregoing disclosure of the preferred embodiments is illustrative of the broad inventive concepts comprehended by the invention.

I claim:

1. An ice making apparatus comprising:
a mold in which water is frozen to form an ice body;
means for ejecting the ice body from the mold;
means for heating the mold to free the ice bodies from the mold; and
means for de-energizing said heating means while at least a portion of said ice body is within said mold during ejection thereof from the mold by the ejecting means.

2. The ice making apparatus of claim 1 wherein said de-energizing means comprises a thermostat in heat transfer association with the mold.

3. The ice making apparatus of claim 2 wherein said thermostat is operable to de-energize said heating means at a sensed temperature of approximately 32° F.

4. An ice making apparatus comprising:
a mold in which water is frozen to form an ice body;
an electric motor;
an electric heater in heat transfer association with the mold for freeing the ice body from the mold;
means for ejecting the freed ice body from the mold; and
control circuit means including a thermostat having a low reset temperature, said thermostat being responsive to the temperature of the mold, a thermostat switch controlled by said thermostat to initiate operation of said motor for ejecting the ice body upon complete freezing thereof, and concurrently for energizing said heater, and electrical circuit means including said thermostat switch, said motor, said heater and a holding switch controlled by the operation of said motor for maintaining energization of said motor independently of said thermostat switch and causing the thermostat switch to control the further energization of the heater whereby said thermostat de-energizes said heater within a single revolution of said ejecting means.

5. The ice making apparatus of claim 4 wherein said thermostat switch is controlled by said thermostat to de-energize said heater at approximately 32° F.

6. The ice making apparatus of claim 4 wherein said thermostat controls said thermostat switch to de-energize said heater while at least a portion of the ice body is within said mold during the ejection thereof from the mold by the ejection means to minimize overheating of the mold during a harvesting cycle.

7. The ice making apparatus of claim 4 wherein said mold is of light weight aluminum construction.

8. The ice making apparatus of claim 7 wherein said mold includes an added mass of aluminum at one end thereof in heat transfer association with said thermostat to insure that said one end of the mold is the last to be cooled during the freezing process.

9. An ice making apparatus comprising:
a mold in which water is frozen to form an ice body;
an electric motor;
an electric heater in heat transfer association with the mold for freeing the ice body from the mold;
means for ejecting the ice body from the mold operated by said electric motor; and
control circuit means including a thermostat operable at a preselected initiation temperature and having a preselected reset temperature higher than the initiation temperature, the thermostat disposed to being responsive to the temperature of the mold, a thermostat switch controlled by the thermostat to initiate operation of said motor for ejecting the ice body upon complete freezing thereof and concurrently to energize said heater, a holding switch controlled by the operation of said motor to subsequently maintain energization of said motor independently of said thermostat switch, and electrical circuit means including said thermostat switch, said motor, said heater and said holding switch for causing said thermostat switch to further control the energization of said heater whereby said thermostat de-energizes said heater prior to the complete removal of the ice body from the mold by the ejecting means.

10. The ice making apparatus of claim 9 wherein said thermostat switch is controlled by said thermostat to de-energize said heater at approximately 32° F.

11. The ice making apparatus of claim 9 wherein said mold is of light weight aluminum construction.

12. The ice making apparatus of claim 11 wherein said mold includes an added mass of aluminum at one end thereof in heat transfer association with said thermostat to insure that said one end of the mold is the last to be cooled during the freezing process.

13. An ice making apparatus comprising:
a mold in which water is frozen to form an ice body; and
means for ejecting the ice body from the mold including:
means for heating the mold for freeing the bonding of the ice body with the mold;
means for removing the freed ice body from the mold; and
means for de-energizing said heating means prior to the complete removal of said ice body from the mold.

14. The ice making apparatus of claim 13 wherein said de-energizing means comprises a thermostat and a thermostat switch controlled by the thermostat.

15. The ice making apparatus of claim 14 wherein said thermostat operates said thermostat switch to de-energize said heating means at approximately 32° F.

16. The ice making apparatus of claim 13 wherein said de-energizing means comprises a switch associated with said removing means for de-energizing said heater prior to the complete removal of the ice body from the mold.

17. The ice making apparatus of claim 16 wherein said switch de-energizes said heater substantially immediately after said ice body is freed from said mold.

18. An ice making apparatus comprising:
a mold;
means for delivering water to said mold which is to be frozen to form an ice body;
means for sensing the temperature of the mold;

an electric heater in heat transfer association with the mold for freeing the ice body from the mold;

an electric motor;

means for ejecting the freed ice body from the mold operated by said electric motor; and a timing control circuit including a temperature switch responsive to said sensing means, a holding switch, and a water valve switch, said control circuit operating said temperature switch in response to said temperature sensing means to initiate operation of said motor for ejecting the ice body upon complete freezing thereof and concurrently for energizing said heater, said motor operating said holding switch thereafter to maintain energization of said motor independently of said temperature switch, said temperature switch operating thereafter to de-energize said heater after said ice body is freed from said mold but before said ice body is completely removed from said mold, and said water valve switch operating said water delivering means after said heater is de-energized and prior to said motor operating said holding switch to de-energize said motor.

19. The ice making apparatus of claim 18 wherein said de-energizing means comprises a thermostat and a thermostat switch controlled by the thermostat.

20. The ice making apparatus of claim 19 wherein said thermostat operates said thermostat switch to de-energize said heating means at approximately 32° F.

21. The ice making apparatus of claim 18 wherein said de-energizing means comprises a switch associated with said removing means for de-energizing said heater prior to the complete removal of the ice body from the mold.

22. The ice making apparatus of claim 21 wherein said switch de-energizes said heater substantially immediately after said ice body is freed from said mold.

* * * * *